US005294205A

United States Patent [19]

Moeck et al.

[11] Patent Number: 5,294,205

[45] Date of Patent: Mar. 15, 1994

[54] APPLICATOR DEVICE

[75] Inventors: Gerhard Moeck, Kirchenehrenbach; Robert Finkenauer, Nuremberg, both of Fed. Rep. of Germany

[73] Assignee: Schwan-Stabilo Schwanhausser GmbH & Co., Nuremberg, Fed. Rep. of Germany

[21] Appl. No.: 93,480

[22] Filed: Jul. 19, 1993

[30] Foreign Application Priority Data

Aug. 20, 1992 [DE] Fed. Rep. of Germany ..... 4227560

[51] Int. Cl.[5] ..... A45D 40/14; A45D 40/06

[52] U.S. Cl. ..... 401/70; 401/68; 401/75

[58] Field of Search ..... 401/62, 68, 70, 75, 401/86, 116, 172

[56] References Cited

U.S. PATENT DOCUMENTS 3,106,908 10/1963 Gretz ..... 401/70 X
3,358,699 12/1967 Bau ..... 401/70
5,085,352 2/1992 Sasaki et al. ..... 401/68 X

FOREIGN PATENT DOCUMENTS 0382590 8/1990 European Pat. Off. .
0382591 8/1990 European Pat. Off. .
8703023 5/1987 Fed. Rep. of Germany .
3728427 12/1988 Fed. Rep. of Germany .
3835680 4/1990 Fed. Rep. of Germany .
3835679 10/1991 Fed. Rep. of Germany .

*Primary Examiner*—Danton D. DeMille
*Attorney, Agent, or Firm*—Bachman & LaPointe

[57] ABSTRACT

An applicator device comprises a front portion and a gripping portion which are rotatable relative to each other to displace a stick of spreadable material axially by means of a screwthreaded spindle. The stick is disposed in a stick tube limitedly axially movable with respect to the front portion, and a first spring is disposed between the stick tube and the front portion. At its rear part which is towards the gripping portion the front portion has a coupling part for non-rotatable connection to a nut member disposed in the gripping portion. The nut member has radially elastically resilient claw portions which can be brought into engagement with the screwthread of the screwthreaded spindle by the coupling part of the front portion bearing against the claws. A second spring is disposed in the gripping portion to urge the screwthreaded spindle rearwardly therein.

12 Claims, 3 Drawing Sheets 30
22
24
24
90
28
20
18
10
12
26
86
88
84
40
38
34
42
32
18
52
36
44
54
48
50
46
56
62
58
64
60
14
74
76
16
78
80
72
68
70
82
66

84
12
34
10
64
76
14

12
84
34
10
64
60
76
14
70
68
66

10
34
20
60
62
60
14
12

20
84
36
44
54
10
12
60
52
92
94
76
14

74
60
70
96
66

APPLICATOR DEVICE

BACKGROUND OF THE INVENTION

One form of applicator device comprising a stick made of a material which can be applied to a surface by being rubbed or spread thereover, referred to herein as a spreadable material, as is to be found in DE 37 28 427 C2, comprises an elongate shaft-like gripping portion in which there is a central cavity axially movably accommodating a screwthreaded spindle which is screwed through an axially immovable nut member. The device further has a casing front portion which is non-rotatably connected to the nut member and in relation to which the gripping portion is rotatable. A stick of a spreadable material is disposed in the casing front portion and can be moved out of same by use of the screwthreaded spindle. Disposed at the front end of the screwthreaded spindle, for moving the stick out of the casing front portion, is a pushing unit which comprises a piston and a piston sleeve embracing the piston, the piston being joined to the front end of the screwthreaded spindle. By virtue of that design configuration the applicator device can be selectively combined with casing front portions provided with extruded or cast sticks. It is in fact possible with that device for the stick to be moved out of the casing front portion, but there is no possibility of the stick being retracted back into same.

DE 38 35 680 A1 discloses a process for producing a stick, more particularly for cosmetic pencils and the like, together with such a stick for a cosmetic pencil, and a cosmetic pencil including such a stick. The operating procedure involved therein is such that the stick is cast in a horizontally disposed mold which is open at least along a part of its peripheral surface. Before the stick material is cast therein, a push member which is displaceable in the axial direction into the mold cavity of the corresponding plastic mold portions can be introduced into the mold arrangement. The positive connection between the stick and the push member, which connection can be produced when the stick is cast in the mold, results in a stick which can be pushed to and fro in the axial direction, with the push member. Consequently, that cosmetic pencil also permits the stick thereof to be retracted into the pencil. The stick is connected at all times with the push member to form a unit, and that is something which represents a not inconsiderable consumption of material. A level of expenditure in terms of production which is not immaterial is also incurred by virtue of the fact that an externally screwthreaded portion is provided at the rearward end part of the push member, and the elongate shaft-like gripping portion thereof is provided with an internal screwthread along the whole of its axial extent. The push member with the externally screwthreaded portion, together with the stick which is positively connected thereto, is only suitable for one-trip use and is thus a disposable article, and that constitutes a wastage item once the stick has been used up.

An applicator device as is to be found in German utility model No 87 03 023 has a stick which can be moved out of a sleeve-like casing by means of a thrust rod of a spindle-type drive arrangement. The stick can be fixed to a holding portion which is guided longitudinally in the casing of the applicator device and against which bears the thrust rod. The device further includes a coil spring which bears at one end against the casing in the interior thereof and at the other end against the holding portion in order to urge the latter against the thrust rod. That arrangement can thus provide for movement of the stick out of and into the casing. Furthermore, with that arrangement, when the casing portion which contains the stick is withdrawn from the casing portion which contains the spindle drive arrangement, the stick is automatically retracted and thereby protected from damage.

A refill stick pencil such as a cosmetic pencil, as is disclosed in DE 38 35 679 C2, includes a stick which is axially displaceable in a gripping sleeve member having an opening for the stick to project therefrom, under the action of a push member which bears against the rear end of the stick. The push member is connected in the direction of axial movement of the stick to a shaft-like sleeve portion which can be screwed against the gripping sleeve portion. In that arrangement the stick is disposed in a substantially tubular plastic molding which encloses it, wherein the plastic molding is axially fixed relative to the gripping sleeve member in a direction towards the opening through which the stick protrudes therefrom, while the push member engages into the plastic molding in such a way that, upon an axial movement towards the opening through which the stick protrudes from the gripping sleeve member, the push member urges the stick out of the plastic molding, the stick being guided over its entire length in the plastic molding. The push member is axially connected to the plastic molding so that the gripping sleeve member is displaceable axially relative to the plastic molding, with the stick contained therein, in a direction away from the opening through which the stick protrudes from the gripping sleeve member, the frictional force against the inside wall of the plastic molding upon axial movement of the push member towards the opening for the stick to protrude being less than in the opposite direction. That pencil is also intended for one-trip use as a disposable item.

An applicator device or a dispenser for a solid or pasty material to be applied thereby, which is contained in a container and which is discharged by a drive means is disclosed in EP 0 382 591 A1. In that arrangement the container is a tube whose interior defines a cylindrical cavity of any cross-section, the tube having a dispenser opening and the product being contained in the tube between the dispenser opening and an axially displaceable piston or plunger. The piston or plunger is displaced by means of the drive device having a pin, at the head end of which the piston or plunger is disposed. The edges of the dispenser opening are at least partially covered by a layer which serves for application of the material to be dispensed and which is made from a material that is permeable to air. The layer at the edges of the dispenser opening is so arranged that it extends over those edges.

A similar dispenser for a product contained in a cylindrical container of any cross-section, in which the product is contained between the dispenser opening and a movable plunger or piston in the container, is disclosed in EP 0 382 590 A1. The piston or plunger is mounted at the head end of a pin which is displaceable with a stepwise motion by means of a displacement mechanism which is movable by the action of a displaceable actuating member in such a way that displacement of the piston or plunger and thus dispensing of the product can be controlled as desired. The mechanism in that dispenser is provided at a first location with a member which is fixed in relation to the container and a member which is movable in relation to the container, the fixed and the movable members being separated from each other by an elastic zone. The actuating member is non-movably connected to the movable member of the mechanism and is subjected to the return force of the elastic zone so as to be returned to the rest position after the dispenser has been in use. At a second location, the pin is non-rotatable in relation to an element of the arrangement and the pin, for the drive motion thereof in the direction of displacement, has a tooth system cooperating with the mechanism by way of locking means.

SUMMARY OF THE INVENTION

An object of the present invention is to provide an applicator device which when necessary can be fitted with a fresh stick of a spreadable material by a simple procedure which does not take up a great deal of time.

Another object of the present invention is to provide an applicator device for a stick of a spreadable material, which can be used in conjunction with sticks of a wide range of different stick textures.

Another object of the present invention is to provide an applicator device which is so designed as to permit a return movement of a stick of cast material.

In accordance with the principles of the present invention, the foregoing and other objects are achieved by an applicator device comprising an elongate shaft-like gripping or handle portion having a central cavity therein, and disposed in the cavity an axially movable screwthreaded spindle and an axially immovable nut member through which the screwthreaded spindle is screwingly passed. The device further includes a casing front portion which is non-rotatably connected to the nut member and in relation to which the gripping portion is rotatable. A stick of a spreadable material is disposed in the casing front portion and can be moved out of same by rotation of the screwthreaded spindle. The stick is disposed in a stick tube which is limitedly axially movable with respect to the casing front portion, a first spring being operatively disposed between the stick tube and the casing front portion and being mechanically stressed upon a forward feed movement of the screwthreaded spindle and mechanically relieved of stress upon a rearward movement of the screwthreaded spindle. At its rearward end part which is towards the gripping portion, the casing front portion has a coupling portion which is non-rotatably connectable or connected to a plug-in portion provided on the nut member. The nut member has radially elastically resilient screwthread claw portions which, in the assembled condition of the applicator device, engage into the screwthreaded spindle by means of the coupling portion at the rear of the casing front portion. In the replacement condition of the applicator device, for replacement of the stick therein, in which the casing front portion is removed from the gripping portion, the screwthread claw means on the nut member are disengaged from the screwthreaded spindle. Disposed in the gripping portion between same and the screwthreaded spindle is a second spring which is mechanically stressed upon a forward feed movement of the screwthreaded spindle and which is operable to move the screwthreaded spindle back into a starting position into the gripping portion again, when the casing front portion is removed from the gripping portion.

As will be seen in greater detail hereinafter in relation to a preferred embodiment of the invention, by virtue of the fact that the stick tube into which the stick material is suitably cast is limitedly axially movable in relation to the casing front portion, it is possible, within the limits of the axial mobility of the stick tube and consequently the stick, for the stick, if it has been unintentionally moved too far out of the casing front portion, to be retracted into the front portion again, with the stick tube. For that purpose the first spring member disposed between the stick tube and the casing front portion serves as a drive element. The design configuration of the casing front portion with the coupling portion thereof and the nut member with the plug-in portion means that it is easily possible to produce a positively locking, non-rotatable connection between the casing front portion and the nut member in the assembled condition of the components of the applicator device. It is thus possible for the elongate gripping portion and therewith the screwthreaded spindle to be turned in relation to the casing front portion and consequently in relation to the nut member so that the screwthreaded spindle which is axially movable in the gripping portion but non-rotatable in relation thereto can be screwed through the nut member and in that way the screwthreaded spindle can be moved relative to the gripping portion and the casing front portion connected thereto, in the axial direction of the applicator device, in order to transport the cast stick relative to the casing front portion of the applicator device, with a movement corresponding to the above-mentioned axial movement of the screwthreaded spindle. By virtue of the design of the nut member with radially resilient screwthread claw portions which, in the assembled condition of the applicator device, by means of the coupling portion of the casing front portion, clampingly engage into the screwthreaded spindle and which, in the condition of the applicator device for replacement of a stick thereof, with the casing front portion being removed from the gripping portion, spring back from the screwthreaded spindle as a result of their radially effective resilient spring action by virtue of being mechanically relieved of stress, and in so moving back come out of engagement therefore with the screwthreaded spindle, it is possible by means of the second spring for the screwthreaded spindle which is thus now no longer held by the claw portions of the nut member to be automatically retracted in the gripping portion. That also means however that the front end of the screwthreaded spindle does not constitute any obstacle or difficulty in terms of fitting to the gripping portion, the casing front portion which has been fitted with a fresh stick in its stick tube. The configuration of the applicator device in accordance with the invention therefore permits a used stick, that is to say a stick tube in which the stick has been used up, to be replaced easily and without involving a great deal of time by a fresh stick in its stick tube, the fresh stick with its stick tube forming a replacement unit or cartridge which is disposed in the casing front portion of the applicator device jointly with the first spring, whereupon the casing front portion, with the new stick, can be connected to the gripping portion. When making the connection between the casing front portion and the gripping portion, the coupling portion at the rearward end part of the casing front portion is simultaneously positively joined to the plug-in portion on the nut member so that the nut member comes into meshing engagement by means of its claw portions with the screwthreaded spindle. The applicator device is then ready again with a suitable fresh stick of cast material.

In accordance with a preferred feature of the invention the casing front portion is provided at its inside at its front end part with a first abutment or stop, while the stick tube has a second abutment or stop. The first spring is preferably disposed in the interior of the casing front portion, around the stick tube, between a third abutment or stop and a fourth abutment or stop. The third abutment or stop in the casing front portion is preferably so disposed that the first spring readily has enough space between the stick tube and the inside wall of the casing front portion so that it is easily possible for a stick tube with a cast stick as well as the first spring to be suitably disposed in the casing front portion.

Preferably the first spring member may be a compression coil spring and between its two ends which bear against the third and fourth abutments may have at least one guide portion of larger diameter. That reliably reduces or prevents possible tilting or jamming of individual coils of the coil spring so that the first spring member can be mechanically stressed at any time or returned to a mechanically relieved condition from a corresponding mechanically stressed condition.

At its rearward end the stick tube is desirably sealingly closed by means of a closure body in the interior of the stick tube. The closure body is preferably a ball of a relatively soft material. By means of the closure body, it is possible for the stick tube to be closed in such a way that for example waterproof texture materials can be cast therein. The closure body, preferably in the form of a ball, can also serve to keep the screwthreaded spindle clean, which is an essential requirement from the point of view of interchangeability of the stick of the applicator device according to the invention.

In another preferred feature the stick tube is sealingly closed at its front end by means of a closure cap so that stick texture materials containing one or more volatile solvents can be easily employed.

Another preferred feature of the invention provides that a compensating or equalising member is disposed at the front end of the screwthreaded spindle. The compensating or equalising member can be a kind of piston or plunger which is formed symmetrically with a respective recess at each of its two end portions which are remote from each other. With that design configuration, one of the two recesses serves for embracing a head portion of the screwthreaded spindle while the opposite second end portion of the compensating or equalising member in the form of a piston, comes to bear snugly against the above-mentioned closure body for closing the stick tube.

Preferably, the coupling portion at the rearward end part of the casing front portion and the plug-in part of the nut member are of cross-sectional profiles which are adapted to each other in respect of shape and which differ from a circular shape, and have conical longitudinal profiles which are also adapted to each other in terms of shape. Not only does that arrangement provide a configuration such as to prevent rotary movement as between the casing front portion and the nut member of the applicator device, but at the same time that affords the advantage of a self-centering action as between the nut member and the casing front portion and thus centering of the screwthreaded spindle in the casing front portion and in the stick tube disposed therein.

In still a further preferred feature of the invention the first spring member is disposed between the casing front portion and the stick tube in such a way that the stick tube protrudes out of the casing front portion at the rear thereof, with a rearward end part, when the casing front portion is removed from the gripping portion and the first spring member is thereby mechanically relieved of stress. The part of the stick tube which projects from the casing front portion at the rear thereof can be easily gripped so that it is in that way easily possible for the stick tube to be drawn rearwardly out of the casing front portion of the applicator device so that a fresh cartridge, that is to say stick with stick tube, can then be disposed in the casing front portion. That design configuration consequently means that the applicator device is easy and convenient to handle in terms of replacing a used stick by a fresh stick. With the same aim of convenience of handling, the second spring member may be disposed between a rear contact portion of the screwthreaded spindle and a front contact portion of the gripping portion, around the screwthreaded spindle, in such a way that the above-mentioned compensating or equalising member disposed at the front end of the screwthreaded spindle protrudes out of the gripping portion when the casing front portion is removed from the gripping portion and as a result the second spring member is mechanically relieved of stress.

In another preferred feature of the invention the applicator device may be completed by a protective cap for covering over the casing front portion and the stick, which can be fitted or is fitted on to same. For that purpose the gripping portion desirably has a part thereof which is designed to receive the cap.

Further objects, features and advantages of the present invention will be apparent from the following description of a preferred embodiment.

DESCRIPTION OF THE PREFERRED EMBODIMENT

Figure 1:
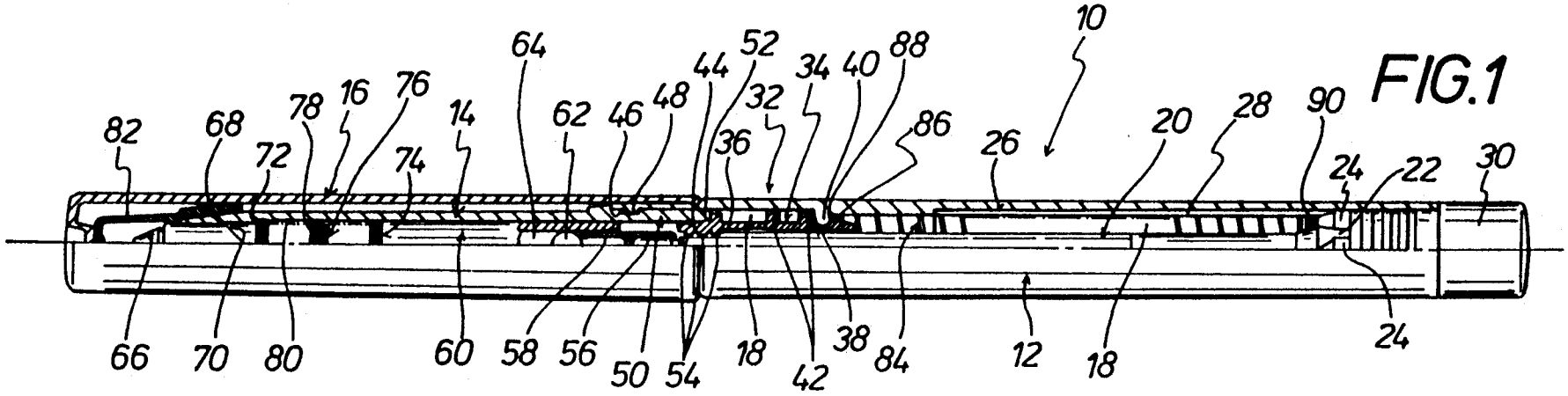
FIG. 1 is a view which is shown in longitudinal section in the upper half of an applicator device according to the invention in the condition of being ready for despatch.

Referring firstly to FIG. 1, shown therein on an enlarged scale and in longitudinal section in the upper half of the Figure is an applicator device which is generally identified by reference numeral 10 and which comprises a shaft-like or elongate gripping or handle portion 12, a casing front portion 14 and a protective cap 16. The gripping portion 12 has in a central cavity 18 therein an elongate screwthreaded spindle 20. At its rearward end portion, which is towards the right in FIG. 1, the screwthreaded spindle 20 has raised portions 24 which are spaced from each other by recesses 22. The raised portions 24 and the recesses 22 thus alternate in the peripheral direction of the screwthreaded spindle 20 at its rearward end portion. The inside wall 26 of the gripping portion 12 has longitudinally extending ribs 28 which, like the recesses 22 at the rearward end portion of the screwthreaded spindle 20, are equidistantly spaced from each other around the periphery of the inside wall 26 of the gripping portion 12, and extend through respective ones of the recesses 22. In that way the screwthreaded spindle 20 is disposed in the cavity 18 non-rotatably relative to the gripping portion 12, by virtue of the co-operation between the recesses 22 and the ribs 28. It will be appreciated however that, guided by the longitudinal ribs 28, the screwthreaded spindle 20 can still perform an axial movement relative to the gripping portion 12.

Disposed at the rearward end portion of the gripping portion 12 is a closure plug or stopper 30 for sealing off the applicator device 10 at that location.

The front end portion as indicated at 32 of the elongate gripping portion 12 accommodates in the central cavity 18 a nut member 34 which will be described in greater detail hereinafter with reference to FIGS. 9 and 10. It will be noted at this point however that the nut member 34 has radially elastically resilient screwthread claw portions 36 (see FIG. 10) and a groove 38 extending therearound on the outside of the nut member.

Raised portions 40 which project inwardly from the inside wall 26 of the gripping portion 12 engage into the peripherally extending groove 38 in the nut member 34. In that way the nut member 34 is axially immovably arranged on the gripping portion 12, but it can still be turned relative to the gripping portion 12. In order to permit the nut member 34 to be turned without tilting in relation to the gripping portion 12, the nut member 34 has centering ribs indicated generally at 42 in FIG. 1 which extend therearound in the peripheral direction of the nut member 34.

Figure 9:
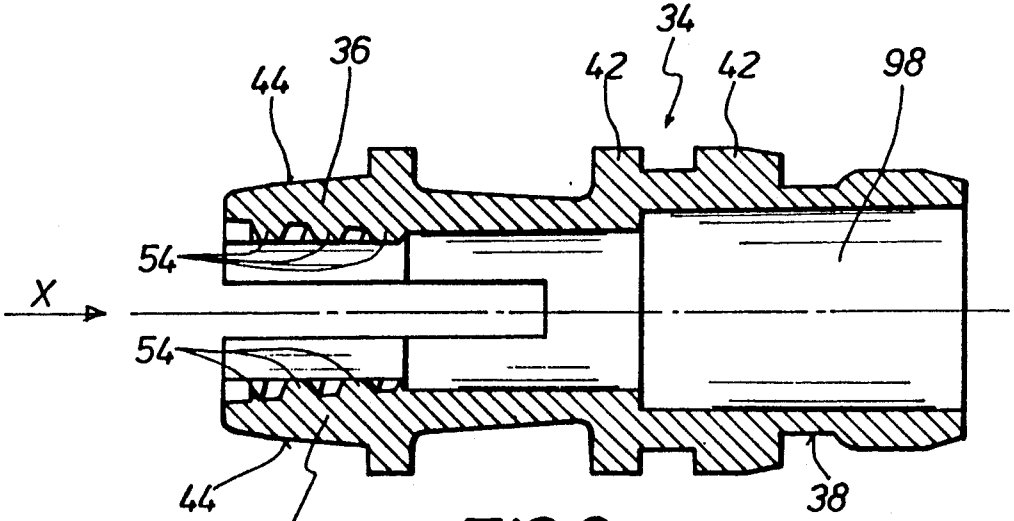
FIG. 9 is a view in section taken along line IX—IX in FIG. 10 through the nut member of the applicator device according to the invention.

Looking still at FIG. 1 but also at FIG. 9, the radially elastically resilient claw portions 36 of the nut member 34 have a plug-in portion 44 which is of a cross-sectional profile differing from a circular shape, and a generally conical longitudinal profile. The conical longitudinal profile of the plug-in portion 44 tapers inwardly in the forwardly facing direction of the applicator device 10, that is to say towards the left in both FIGS. 1 and 9. As can be seen from FIG. 1, the plug-in portion 44 is adapted to engage into the casing front portion 14 in a manner to be described in greater detail hereinafter.

The front portion 14 of the applicator device 10 has a recess 46 extending therearound in its external surface. Projections 48 which are provided at the front end portion 32 of the gripping portion 12 on the inside wall 26 thereof latchingly engage into the recess 46 in the front portion 10, in the assembled condition of the applicator device 10 shown in FIG. 1. That provides a connection which is virtually play-free in the axial direction between the gripping portion 12 and the front portion 14. It is nonetheless possible to turn the gripping portion 12 in relation to the front portion 14 and vice-versa.

At its rearward end part 50 the front portion 14 is shaped with a coupling portion 52 having a cross-sectional profile and a longitudinal profile which are adapted in term of shape to the respectively corresponding profiles of the plug-in portion 44 of the nut member 34 and the claw portions 36 thereof. Consequently, when the front portion 14 is in the condition of being fitted on to the gripping portion 12, there is a positively locking connection between the front portion 14 and the nut member 34 while at the same time the generally conical longitudinal profiling of the coupling portion 52 of the front portion 14 and the plug-in portion 44 of the claw portions 36 on the nut member 34 cause the claw portions 36 to be urged radially inwardly so that screwthread tooth parts indicated at 54 in FIGS. 9 and 10, on the claw portions 36, meshingly engage into the channel defined by the screwthread on the screwthreaded spindle 20. If in that condition of the applicator device 10 the gripping portion 12 is turned relative to the front portion 14, as a result the screwthreaded spindle 20 which is non-rotatably connected to the gripping portion 12 in the manner described above is screwed through the nut member 34 and thus the screwthreaded spindle 20 is axially displaced within the cavity 18 in the applicator device 10.

At its front end which is towards the left in FIG. 1, the screwthreaded spindle 20 has a head portion 56 on to which is fitted a compensating or equalising member 58. The purpose of the compensating or equalising member 58 is to compensate in a simple fashion for manufacturing tolerances in respect of the various components of the applicator device 10. In the assembled condition of the applicator device 10, the compensating member 58 extends into a stick tube 60 which is shown in longitudinal section in FIG. 1 only at its rearward end portion which is thus towards the right in FIG. 1. The stick tube 60 which serves to accommodate a stick of spreadable material to be applied by the applicator device is sealingly closed at its rearward end portion in its interior by means of a closure body 62. The closure body 62 is preferably a ball of a relatively soft material which is thus inserted into the stick tube 60.

Reference numeral 64 in FIG. 1 denotes a stick comprising spreadable material, which is cast into the stick tube 60. The stick 64 projects out of the stick tube 60 with a suitably shaped front end portion indicated at 66 in FIG. 1.

At its front end part which is towards the left in FIG. 1, the front portion 14 of the applicator device 10 is provided on its inside with a first abutment or stop 68. On its outside the stick tube 60 has a second abutment at 70 by which axial mobility of the stick tube 60 relative to the front portion 14 is limited in a defined manner when the second abutment 70 of the stick tube 60 bears against the first abutment 68 of the front portion 14. The front portion 14 is also provided with a third abutment indicated at 72, as can also be seen in FIG. 7, while the stick tube 60 has a fourth abutment indicated at 74. Reference numeral 76 denotes a first spring member which is operatively disposed between the third and fourth abutments 72, 74. The spring member 76 is preferably, as illustrated, a compression coil spring which is thus disposed around the stick tube 60. In the embodiment illustrated the first spring member 76 has a guide portion 78 which is disposed between the respective ends of the spring member 76 and the diameter of which is larger than the diameter of the rest of the spring member 76, as far as the two mutually remote end portions thereof. The guide portion 78 of the first spring member 76 bears against a corresponding portion as indicated at 80 of the inside wall surface of the front portion 14 of the applicator device 10, to ensure that the spring member 76 is suitably guided in the front portion 14.

For reliably sealing off the stick 64 in the stick tube 60, the stick tube 60 is sealingly closed at its front end by a closure cap 82 disposed in the interior of the protective cap 16 which is shown in FIG. 1 as being fitted on to the applicator device 10.

Disposed in the central cavity 18 of the gripping portion 12, adjacent the nut member 34, is a second spring member 84 which is preferably as illustrated a compression coil spring. The front end 86 of the spring member 84, which is towards the left in FIG. 1, bears against a support or contact portion 88 of the gripping portion 12, while the other rearward end 90 of the second spring member 84 bears against a support or contact portion of the screwthreaded spindle 20.

When, with the protective cap 16 removed from the applicator device 10, the gripping portion 12 is suitably turned in relation to the front portion 14, then as a result the screwthreaded spindle 20 is screwed forwardly and thus towards the left in FIG. 1 through the nut member 34 which is connected to the front portion 14, whereby the stick 64 is correspondingly moved out of the stick tube 60. At the same time the first spring member 76 and the second spring member 84 are mechanically stressed between their respective abutments and contact portions.

Figure 2:
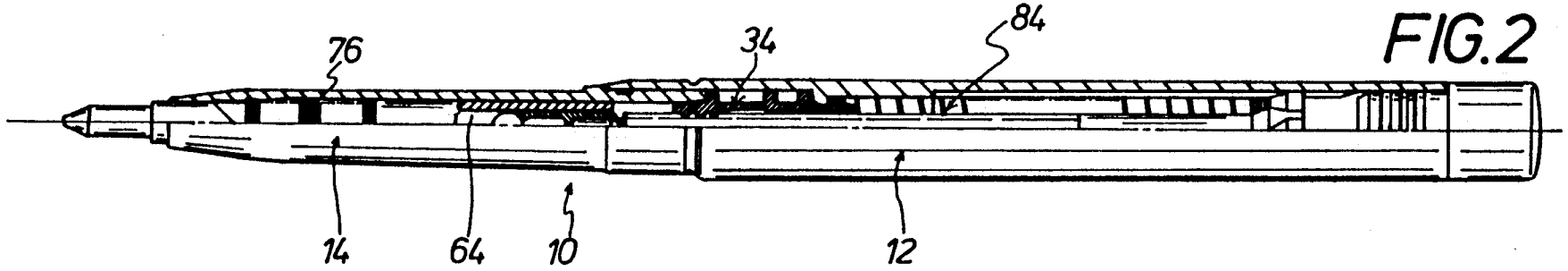
FIG. 2 is a view similar to FIG. 1 of the applicator device in an operative position in which the stick thereof has been unintentionally moved too far out of the front portion of the applicator device.
Figure 3:
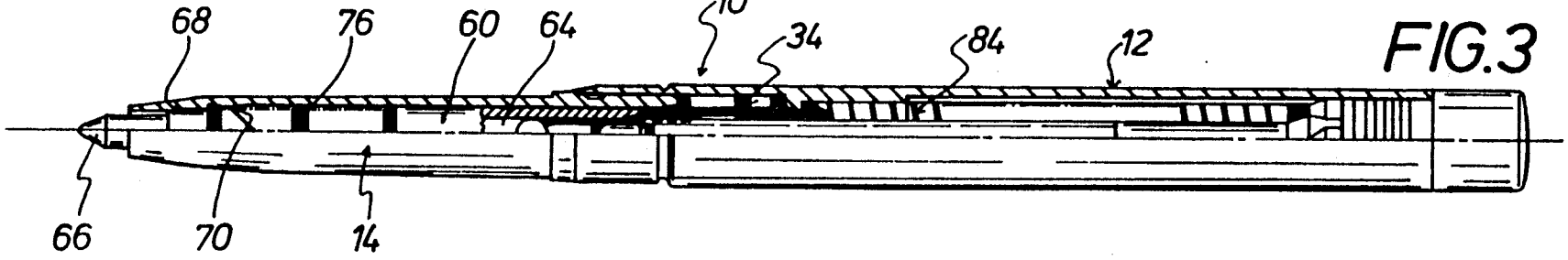
FIG. 3 is a view corresponding to FIGS. 1 and 2 of the applicator device showing it in a condition in which the stick which had been moved too far out of the stick tube has been retracted into a suitable application position again by a suitable retraction movement of the stick with stick tube.

If for example the stick 64 is unintentionally screwed to an excessive distance out of the front portion 14 of the applicator device 10, as is shown in FIG. 2, it is easily possible for the stick 64 to be suitably moved back into the front portion 14 again. For that purpose, it is only necessary for the gripping portion 12 to be turned in the other direction of rotation in relation to the front portion 14, whereby the two spring members 76 and 74 are correspondingly mechanically relieved of the stress therein. As a result of the relief of stress of the first spring member 76, the stick tube 60 and therewith the stick 64 therein are moved back into the front portion 14 so that the shaped front end part 66 of the stick 64 then again only projects out of the front portion 14 by the desired distance, as can be seen from FIG. 3. In that retracted position therefore the second abutment 70 of the stick tube 60 is correspondingly spaced from the first abutment 68 on the front portion 14.

Figure 4:
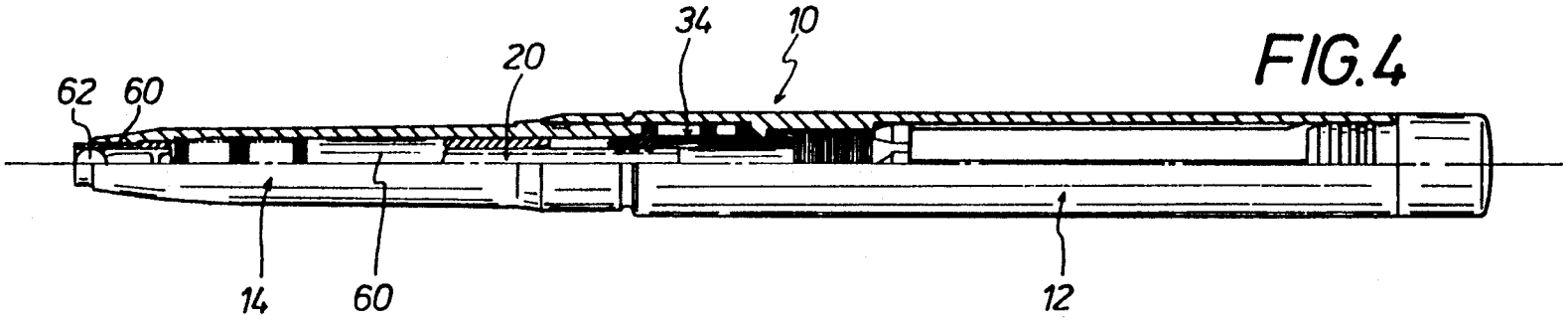
FIG. 4 is a view of which the upper half is in longitudinal section of the applicator device in which the stick has been completely used up.
Figure 5:
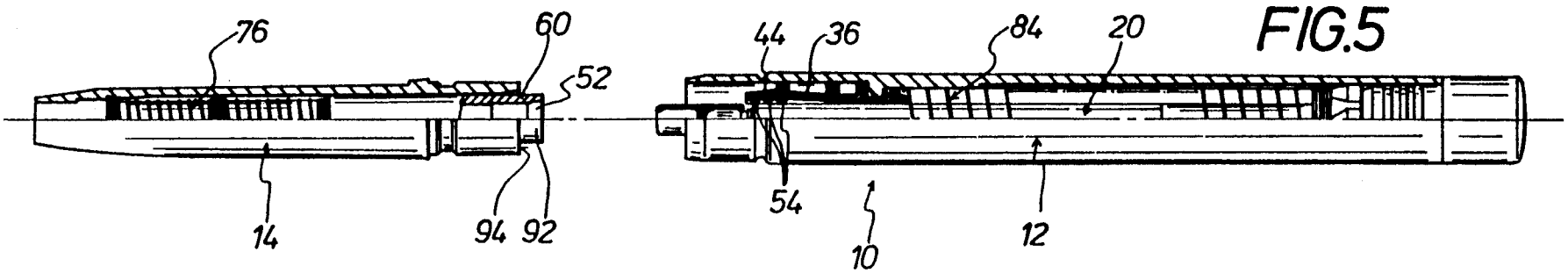
FIG. 5 is a view of the applicator device shown in FIGS. 1–4, in longitudinal section in its upper half, with the front portion thereof removed from the elongate gripping portion of the device.
Figure 6:
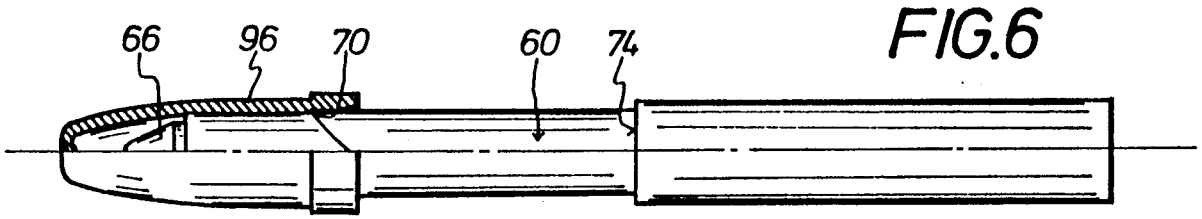
FIG. 6 is a side view of a stick disposed in a stick tube, with a closure cap which is shown half in longitudinal section.

FIG. 4 shows an operative position of the applicator device 10, in which the screwthreaded spindle 20 has been screwed forwardly through the nut member 34 to such a degree that the closure body 62 is at the front end of the stick tube 60. That means that the stick which was in the stick tube 60 has been completely consumed. In order now to be able to arrange an unused fresh stick in the front portion 14 of the applicator device, the front portion 14 is pulled off the gripping portion 12 as is shown in the part-sectional view in FIG. 5. As soon as the front portion 14 has been removed from the gripping portion 12 of the applicator device 10, the positively locking connection between the coupling portion 52 of the front portion 14 of the casing of the applicator device and the plug-in portion 44, at the radially resilient claw portions 36, is disengaged, whereby the claw portions 36 which are urged radially inwardly in the assembled condition of the applicator device 10 can be mechanically relieved of stress and can thus move radially outwardly under the spring effect inherent in the claw portions 36. That disengages the meshing engagement between the screwthread tooth parts 54 on the claw portions 36 and the channel defined by the screwthread of the screwthreaded spindle 20 so that the second spring member 84 can be mechanically relieved of stress and can thus correspondingly expand. As a result the screwthreaded spindle 20 is moved back into the gripping portion 12, into the starting position shown in FIGS. 1 and 5. At the same time the first spring member 76 can also be mechanically relieved of stress and can thus expand, whereby the stick tube 60 is displaced rearwardly (towards the right in for example FIG. 1) in relation to the front portion 14. When that happens, the stick tube 60 is displaced rearwardly to such an extent that a rearward portion indicated at 92 in FIG. 5 protrudes from the rearward end 94 of the front portion 14 and can be gripped without difficulty so that the empty stick tube 60 can now be pulled out of the front portion 14. A fresh stick which is suitably cast in a stick tube 60 can now be fitted in the front portion 14. Such a cartridge consisting of a stick cast in a stick tube 60 is shown in FIG. 6 which also shows partly in section a protective cap 96 which serves to protect the stick or the shaped front end portion 66 thereof from mechanical, physical or chemical influences, drying out, and the like. FIG. 6 also shows the second abutment 70 on the stick tube 60 and the fourth abutment 74 on the stick tube 60.

Figure 7:
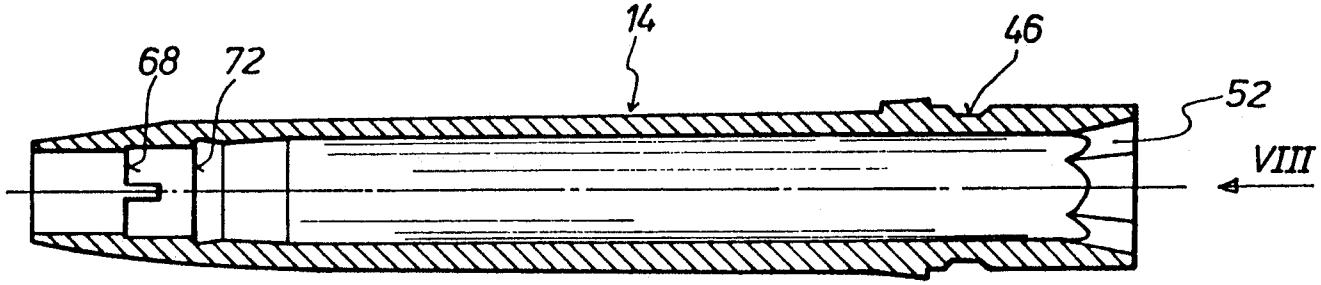
FIG. 7 is a view in longitudinal section through the casing front portion of the applicator device according to the invention.
Figure 8:
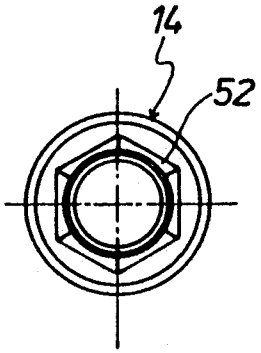
FIG. 8 is a view of the front portion looking in the direction indicated by the arrow VIII in FIG. 7.

Referring now to FIGS. 7 and 8, shown therein on an enlarged scale is the front portion 14 of the applicator device 10, illustrating the first abutment 68 and the third abutment 72 as well as the peripherally extending recess 46 on the front portion 14 and the coupling portion 52. FIG. 7 clearly shows the generally conical longitudinal profile of the coupling portion 52 while FIG. 8 particularly clearly shows the non-circular cross-sectional profile of the coupling portion 52.

Figure 10:
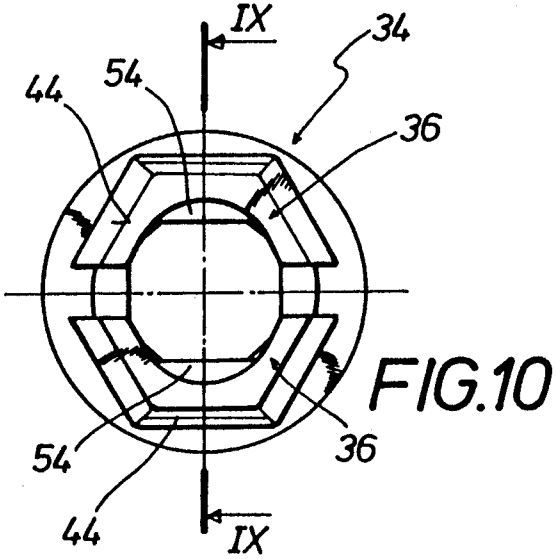
FIG. 10 is a view of the nut member viewing in the direction indicated by the arrow X in FIG. 9.

FIGS. 9 and 10 show on an even larger scale the nut member 34 with two screw-thread claw portions 36 which are disposed in diametrally opposite relationship and which project at one side from a sleeve-like body portion 98 of the nut member 34. The body portion 98 of the nut member 34 has two centering ribs 42 which extend around the nut member 34 at a spacing from each other in the axial direction of the nut member 34. Reference numeral 38 identifies the groove which extends around the nut member 34, for receiving in latching engagement the raised portions indicated at 40 in FIG. 1 which project inwardly from the gripping portion 12 of the applicator device.

As indicated above, each claw portion 36 has screwthread tooth parts 54 and a coupling portion 52 which is of a generally conical longitudinal profile as shown in FIG. 9, as well as a cross-sectional profile as shown in FIG. 10, which differs from a circular shape. The plug-in portion 44 of the nut member 34 is adapted in terms of shape to the coupling portion 52 of the front portion 14 in order to suitably fit therein.

The structure of the applicator device according to the invention having been described above, the mode of operation thereof will now be set forth:

When the front portion 14 is withdrawn or removed from the gripping portion 12, the claw portions 36 of the nut member 34 spring radially outwardly so that the claw portions come out of engagement with the screwthreaded spindle 20. The second spring 84 in the interior of the gripping portion 12 can be mechanically relieved of stress and thus expand, and pulls the screwthreaded spindle 20 back into the gripping portion 12 into its rearward rest position. The screwthreaded spindle 20 is therefore then in its inwardly displaced or retracted starting position again. At the same time the first spring 76 in the interior of the front portion 14 of the applicator device 10 can be mechanically relieved of stress and thus expand, whereby the stick tube 60 is pushed out of the rearward end part of the front portion 14 by a given amount which may be for example of the order of magnitude of 5 mm. The stick tube can then be gripped at that rearwardly projecting part of the stick tube, and pulled out of the front portion 14. In that way, an unused fresh cartridge consisting of stick 64 and associated stick tube 60 can then be inserted into the front portion 14 of the applicator device, whereupon the front portion 14 with stick and stick tube therein can be re-connected to the gripping portion 12 and the applicator device can thus be re-assembled. In that operation the claw portions 36 of the nut member 34 are brought into meshing engagement with the screwthread on the screwthreaded spindle 20 so that the screwthreaded spindle 20 is suitably engaged with and can thus be screwed through the nut member 34 in order to move the stick 64 in relation to the stick tube out of the front portion 14 of the applicator device, as desired. During that forward movement both the first and the second springs 76 and 84 are mechanically stressed, that is to say compressed, so that it is possible for a stick which has been accidentally moved out of the front portion 14 to an excessive extent to be moved back into the front portion again, by displacement of the stick tube, by suitably turning the gripping portion 12 relative to the front portion 14. As already mentioned therefore the forward movement of the stick is produced by the screwthreaded spindle, on being suitably turned in the forward direction, firstly moving the stick tube forwardly in the front portion 14 until it bears against the first abutment 68 at the front of the front portion. A further forward movement of the stick tube relative to the front portion 14 is then no longer possible, that is to say, after the stick tube comes to bear against that first abutment, the stick can now be further moved out of the front portion 14, in relation to the axially immovable stick tube, by suitable screwing movement of the screwthreaded spindle 20. As the stick 64 is used up, by suitably turning the gripping portion the screwthreaded spindle 20 can be correspondingly moved forwardly and the stick material is also pushed forwardly. If the screwthreaded spindle is turned in the opposite direction so as to retract it again, the pressure which is applied to the stick by the screwthreaded spindle correspondingly decreases. The stick tube 60 is correspondingly pushed back into the front portion 14 by means of the first spring 76.

For replacement of the stick tube in which the stick for example has been entirely used up, the front portion 14 is withdrawn or removed from the elongate gripping portion. When that is done, the claw portions 36 are disengaged from the screwthreaded spindle 20 so that the screwthreaded spindle is no longer held by the nut member 34. When that happens, the screwthreaded spindle 20 is moved back into the gripping portion 12 and thus into its starting position by means of the second spring 84. As, when the front portion 14 is in that condition of being removed from the gripping portion 12, the pressure of the screwthreaded spindle on the first spring 76 in the interior of the front portion 14 also ceases to be applied, the first spring member 76 can be mechanically relieved of stress and thus expand whereby the stick tube is urged by the first spring rearwardly out of the front portion 14 to such an extent that it can be gripped by hand and withdrawn from the front portion. After that therefore the front portion is ready to be fitted with a fresh stick tube with stick. The front portion with stick and stick tube is then re-connected to the gripping portion so that the applicator device is again ready for use.

It will be appreciated that the above-described construction according to the invention has been set forth solely by way of example and illustration of the principles of the invention and that various modifications and alterations may be made therein without thereby departing from the spirit and scope of the invention.

What is claimed is:

1. An applicator device comprising: an elongate gripping portion having a cavity therein; disposed in said cavity axially movably therein a screwthreaded spindle and an axially immovable nut means through which the screwthreaded spindle is screwable, the nut means having radially resilient screwthread claw means co-operable with the screwthread of the screwthreaded spindle; a casing front portion cooperable with the gripping portion in alignment therewith and having a rearward end part which is towards the gripping portion and said rearward end part having a coupling means for non-rotatable connection to said nut means, whereby said front portion is non-rotatably connected to said nut means and said front portion and said gripping portion are rotatable relative to each other in the assembled condition thereof in which said claw means engage into the screwthread of said screwthreaded spindle and are out of engagement therewith in the condition of the applicator device in which said front portion is removed from said gripping portion; a stick comprising a spreadable material which is disposed in said front portion and which is adapted to be moved out of said front portion by means of said screwthreaded spindle; a stick tube accommodating said stick and limitedly axially movable with respect to said front portion; a first spring means operatively disposed between said stick tube and said front portion and adapted to be mechanically stressed upon a forward feed movement of said screwthreaded spindle and mechanically relieved of stress upon a rearward movement of said screwthreaded spindle; and a second spring means disposed in said gripping portion between same and said screwthreaded spindle and adapted to be mechanically stressed upon a forward feed movement of said screwthreaded spindle and operable to move said screwthreaded spindle back into a starting position into said gripping portion when said front portion is removed from said gripping portion.

2. An applicator device as set forth in claim 1 wherein said nut means has a plug-in portion co-operable with said coupling means for said non-rotatable connection of said coupling means to said nut means.

3. An applicator device as set forth in claim 1 wherein said front portion has a front end part and a first abutment on the inside of said front end part, and wherein said stick tube has a second abutment co-operable with said first abutment.

4. An applicator device as set forth in claim 1 wherein said front portion has a third abutment and said stick tube has a fourth abutment and wherein said first spring means is disposed in the interior of said front portion around said stick tube between said third and fourth abutments.

5. An applicator device as set forth in claim 4 wherein said first spring means has first and second ends co-operating with said third and fourth abutments, and at least one guide portion between said first and second ends and of larger diameter than same.

6. An applicator device as set forth in claim 1 wherein said stick tube has a rearward end part, and further including a closure means in the interior of said stick tube and sealingly closing same at said rearward end part.

7. An applicator device as set forth in claim 1 and further including a closure cap for sealingly closing said stick tube at its front end.

8. An applicator device as set forth in claim 1 and further including a compensating member disposed at the front end of said screwthreaded spindle.

9. An applicator device as set forth in claim 1 wherein said coupling means and the portion of said nut means co-operating therewith have cross-sectional profiles which are adapted to each other in respect of shape and which differ from a circular shape, and generally conical longitudinal profiles which are adapted to each other in respect of shape.

10. An applicator device as set forth in claim 1 wherein said first spring means is operatively disposed between said front portion and said stick tube in such a way that said stick tube projects out of said front portion at the rear thereof with a rear end part when said front portion is removed from said gripping portion, whereby said first spring means is relieved of stress.

11. An applicator device as set forth in claim 1 wherein said screwthreaded spindle has a rear contact portion and said gripping portion has a front contact portion and wherein said second spring means is disposed between said contact portions around said screwthreaded spindle, the arrangement being such that the front end part of the screwthreaded spindle projects out of said gripping portion when said front portion is removed therefrom and said second spring means is thus relieved of stress.

12. An applicator device as set forth in claim 1 and further including a protective cap member for covering said front portion and said stick.

* * * * *